United States Patent [19]

Mastronarde

[11] 4,445,462

[45] May 1, 1984

[54] WASTE HEAT BOILER WITH FEED MIXING NOZZLE

[75] Inventor: Thomas P. Mastronarde, South Windsor, Conn.

[73] Assignee: Combustion Engineering, Inc., Windsor, Conn.

[21] Appl. No.: 437,983

[22] Filed: Nov. 1, 1982

[51] Int. Cl.[3] ..... F22B 33/00; F22D 1/00

[52] U.S. Cl. ..... 122/7 R; 122/20 B; 122/492

[58] Field of Search ..... 122/7 R, 1 C, 20 B, 122/34, 36, 421, 492; 110/234

[56] References Cited

U.S. PATENT DOCUMENTS

| | | | |
|---|---|---|---|
| 1,795,317 | 3/1931 | Sengstaken | 122/1 C |
| 3,190,808 | 6/1965 | Dodd | 122/7 R |
| 3,202,134 | 8/1965 | Marcheix | 122/7 R |
| 3,285,241 | 11/1966 | Bordeaux | 122/17 |
| 3,409,074 | 11/1968 | Wagner et al. | 122/7 R |
| 3,719,172 | 3/1973 | Charcharos et al. | 122/7 R |
| 4,098,324 | 7/1978 | Kummel et al. | 122/7 R |
| 4,163,430 | 8/1979 | Neumann | 122/20 B |
| 4,258,668 | 3/1981 | Bekedam | 122/1 C |
| 4,318,368 | 3/1982 | Carson et al. | 122/492 |

*Primary Examiner*—Henry C. Yuen

*Attorney, Agent, or Firm*—Arthur E. Fournier, Jr.

[57] ABSTRACT

A waste heat boiler (10, 38) of the type which is particularly suited for use in marine applications and which incorporates a feed mixing nozzle (50) that is operative for purposes of effecting, by utilizing steam taken from the steam generating bank (20, 48), a preheating of the feedwater that is fed to the steam drum (14, 42). In addition to the aforesaid feed mixing nozzle (50), the subject waste heat boiler (10, 38) includes a feedwater control valve (12, 40), a steam drum (14, 42), a circulation pump (18, 46), a steam generating bank (20, 48) and a centrifugal water separator (16, 44). The feedwater control valve (12, 40) is employed to modulate the flow rate of the incoming feedwater in order to maintain the desired level of water in the steam drum (14, 42). In turn the latter steam drum (14, 42) is intended to function in the manner of a reservoir for the circulating water that through the operation of the circulating pump (18, 46) is supplied to the steam generating bank (20, 48). The circulating water which is supplied to the steam generating bank (20, 48) is heated therein to saturation temperature, and steam is generated thus. A water-steam mixture is returned from the steam generating bank (20, 48) to the steam drum (14, 42) and is directed into the centrifugal water separator (16, 44) that is suitably located within the steam drum (14, 42). It is in the centrifugal water separator (16, 44) that the separation of the water-steam mixture is effected such that water is returned to the lower portion of the steam drum (14, 42) and the steam is supplied to the upper portion of the steam drum (14, 42). The preheating of the feedwater is accomplished by directing the incoming feedwater through an internal feed pipe (66) to the mixing nozzle (50), the latter being positioned in the line (60) through which the water-steam mixture is returned to the steam drum (14, 42).

6 Claims, 2 Drawing Figures

WASTE HEAT BOILER WITH FEED MIXING NOZZLE

BACKGROUND OF THE INVENTION

This invention relates to boilers, and in particular to waste heat boilers of the type that are intended for use in marine applications.

It is known that waste heat boilers are designed to be operative to produce low cost steam from heat that would otherwise be lost. Moreover, the manner in which waste heat boilers accomplish this function, i.e., the mode of operation thereof, is well-known to those who are skilled in the art. As regards the matter of the mode of operation of waste heat boilers, one aspect thereof is of particular interest. Reference is had here to the fact that waste heat boilers operating at low pressures and low circulation ratios characteristically demonstrate extreme sensitivity to the occurrence of certain types of changes in operating conditions. More specifically, such waste heat boilers are known to be extremely sensitive to pressure or temperature changes that take place within that portion of the waste heat boiler which is known as the steam generating bank.

With respect to many of the waste heat boilers that are constructed in accordance with existing designs, it is known that relatively small changes in either operating pressure or the temperature of the entering water are capable of producing rapid changes in the proportions of water and steam that exist within the steam generating bank of the waste heat boiler. However, those changes in the proportions of water and steam that are present in the steam generating bank of the waste heat boiler can be minimized. Namely, this can be had through the proper selection of pressure control system components. Moreover, the result thereof is that the shrinkage and swelling that occurs in the amount of water which is contained in the steam drum of the waste heat boiler is attenuated.

On the other hand, changes in the temperature of the entering water produce shrinkage and swelling of the amount of water in the steam drum of the waste heat boiler. This shrinkage and swelling manifests itself in the form of large cyclic changes in water level within the steam drum of the waste heat boiler. Further, such shrinkage and swelling occasioned by changes in the temperature of the entering water cannot be attenuated simply through the selection and employment of certain particular control components.

This phenomenon of thermal shrink and swell attributable to water temperature changes is known to bear a direct relation to changes in water temperature that take place within the steam drum of the waste heat boiler. Moreover, it is further known that the changes in water temperature which take place in the steam drum of the waste heat boiler are themselves a function of the occurrence of changes in the rate at which incoming feed water flows to the steam drum.

A conventionally constructed waste heat boiler commonly includes the following components suitably interconnected in operative relation one with another: a feedwater control valve, a steam drum, a circulating pump, a steam generating bank and a centrifugal water separator. Further, in accordance with the mode of operation of such a conventionally constructed waste heat boiler the feedwater control valve is operative to modulate the flow rate to the steam drum of the incoming feedwater so as to maintain within the steam drum the desired water level, i.e., the water level that has been established based on design considerations. The steam drum on the other hand is operative as a reservoir for circulating water that is supplied by the circulating pump to the steam generating bank. Note is taken here of the fact, however, that in some installations, the circulating pump is not required if sufficient natural circulation can be obtained. The circulating water which is supplied to the steam generating bank is heated therein to saturation temperature whence steam is generated. Finally, from the steam generating bank the water-steam mixture is returned to the steam drum, and more specifically to the centrifugal water separator that is located within the steam drum. The centrifugal water separator effects the return of the water to the lower portion of the steam drum while the steam is fed to the upper portion of the steam drum.

When the conventionally constructed waste heat boiler is operating under steady state conditions, the tubing which comprises the steam generating bank thereof is divided into two different flow regimes. Namely, those tubes of the steam generating bank that receive the incoming circulating water are filled with water which is at almost constant density. That is, the incoming circulating water is being heated within the steam generating bank to saturation temperature from an initially subcooled condition.

The remainder of the tubing that comprises the steam generating bank is filled with a constant temperature water-steam mixture of gradually decreasing density. The temperature of the circulating water entering the steam generating bank of the conventionally constructed waste heat boiler determines the amount of water and the amount of steam which the steam generating bank contains. More specifically, a decrease in the temperature of the incoming circulating water causes a larger mass of water to be retained within the steam generating bank. While an increase in the temperature of the incoming circulating water causes a smaller mass of water to be retained within the steam generating bank. If the incoming circulating water is supplied at saturation temperature to the steam generating bank, no subcooled section of tubing exists therewithin. Accordingly, boiling of the incoming circulating water will take place within the initial section of tubing of the steam generating bank. Therefore, the overall water-steam mixture contained within the steam generating bank will represent the minimum mass of water obtained under steady flow conditions of a waste heat boiler constructed in accordance with conventional design.

By way of illustration of the foregoing, suppose steady conditions at 100 psig exists. Moreover, suppose subcooled circulating water is being supplied at 50° F. below saturation temperature to the steam generating bank of a waste heat boiler of conventional construction. Under this set of circumstances let us assume that the steam generating bank contains six cubic feet of water and twenty cubic feet of steam. On the other hand, with no subcooling of the incoming circulating water which is supplied to the steam generating bank, the latter might contain two cubic feet of water and twenty-four cubic feet of steam. It thus can be seen that the aforedescribed change in the temperature of the incoming circulating water from a temperature of 50° F. below saturation temperature to saturation temperature causes a mass of water, which is represented by the reduction of four cubic feet in water volume, to be transferred from the steam generating bank, which is a fixed volume container, to the steam drum of the waste heat boiler. Thus, since the volume of water which the steam drum contains varies with the water level therein, the effect of the aforesaid difference in the temperature of the incoming circulating water is that changes in the relative amounts of water and steam in the steam generating bank are directly reflected as changes in water level within the steam drum of the waste heat boiler.

From the preceding discussion, it should now be readily apparent that the phenomenon of cyclic thermal shrink and swell in waste heat boilers that are of conventional design and to which reference has been had previously hereinbefore is caused by the conflicting response of the system composed of the steam drum and steam generating bank to a change in the rate of flow of feedwater to the steam drum. More specifically, the aforereferenced thermal shrink and swell is occasioned by the following sequence. A decrease in water level within the steam drum causes the feedwater valve to open thereby causing an increase in the rate of flow of feedwater to the steam drum. This increase in the rate of flow of feedwater to the steam drum in turn causes a decrease in the temperature of that water which is present in the lower portion of the steam drum. Moreover, this reduction in the temperature of the water means that it is water at a reduced temperature, i.e., that present in the lower portion of the steam drum, which is fed as circulating water to the steam generating bank. The increased subcooling of the circulating water that is supplied to the steam generating bank causes a larger volume of water to be retained therewithin. Further, since this circulating water is transferred from the steam drum at a much higher rate of flow then that at which the feedwater is entering the steam drum, the water level within the steam drum falls. However, as the water level falls, additional feedwater is admitted to the steam drum causing further subcooling of the water therein. Eventually though when a temperature equilibrium of the water within the lower portion of the steam drum is established, the water level within the steam drum will begin to rise. Then as the water level increases within the steam drum, the rate of flow of the feedwater to the steam drum is reduced thereby producing an increase in the temperature of the circulating water that is being supplied to the steam generating bank. This increase in the temperature of the circulating water being supplied to the steam generating bank in turn reduces the amount of water present therewithin with the excess water being recirculated back to the steam drum and causing a rapid increase in water level within the steam drum.

It is obviously desirable that, if possible, the steam drum of the waste heat boiler be suitably constructed such that the water level therewithin is not subject to excessive excursions. That is, in the case, for example, of the hypothetical situation that was posed hereinbefore the steam drum should be capable of assimilating therewithin the additional four cubic feet of water received thereby from the steam generating bank without the water level in the steam drum being caused to vary too extensively from whatever the norm therefor is.

For those applications wherein space is not a factor, it has been known to make use of steam drums that are suitably sized so that the addition thereto, for instance, of another four cubic feet of water from the steam generating bank would not cause the water level in the steam drum to deviate from the norm beyond an acceptable amount. Namely, in the case of such applications the steam drum is made sufficiently large that another four cubic feet of water added thereto does not cause the water level to rise therewithin to an appreciable extent, i.e., to an unacceptable degree.

However, there are other applications where space is at a premium. Reference is had here in particular to marine applications in which the space allotted for locating the waste heat boiler aboard the ship is relatively limited. In these instances, the attenuation of thermal shrink and swell in the steam drum of the waste heat boiler can not be realized simply by increasing the dimensions of the waste heat boiler. In this context, the extent to which the water level of the steam drum is permitted to deviate, i.e., the magnitude of the allowed excursion thereof, from the norm therefor is commonly on the order of only ± two inches.

A need has thus been evidenced in the prior art for a new and improved waste heat boiler of the type that is particularly suited to be utilized in marine applications. More specifically, such a new and improved waste heat boiler has been sought which is capable of operating in such a manner that the thermal shrink and swell which takes place in the steam drum and which is occasioned by changes in water temperature is attenuated. Moreover, there is sought such a new and improved waste heat boiler for marine applications which in addition is advantageously characterized by the fact that a more efficient and effective mixing of the water within the steam drum occurs.

It is, therefore, an object of the present invention to provide a new and improved form of waste heat boiler of the type that is operative to produce low cost steam from heat that would otherwise be lost.

It is another object of the present invention to provide such a waste heat boiler which is particularly suited for use in marine applications.

It is still another object of the present invention to provide such a waste heat boiler which is effective in attenuating the thermal shrink and swell which takes place within the steam drum and which is occasioned by changes in water temperature.

A further object of the present invention is to provide such a waste heat boiler which is effective in preventing excursions of more that ± two inches in the water level within the steam drum.

A still further object of the present invention is to provide such a waste heat boiler that is operative to provide a more efficient and effective mixing of water within the steam drum.

Yet another object of the present invention is to provide such a waste heat boiler that is equally applicable for use in new applications as well as retrofit applications.

Yet still another object of the present invention is to provide such a waste heat boiler that is relatively inexpensive to provide, yet is reliable in operation.

SUMMARY OF THE INVENTION

In accordance with one aspect of the invention, there is provided a new and improved form of waste heat boiler that is particularly suited for employment in marine applications. The subject waste heat boiler is characterized principally by the fact that it embodies a feed mixing nozzle that is operative for purposes of effecting a preheating of the feedwater which is supplied to the steam drum of the waste heat boiler. More specifically, the incoming feedwater to the steam drum is heated by virtue of being mixed with some of the steam that leaves the steam generating bank of the waste heat boiler. The mode of operation of the subject waste heat boiler is such that in accord therewith desirably a sufficient amount of feedwater is fed to the steam drum so that the proper water level is caused to be maintained in the steam drum. For this purpose the subject waste heat boiler embodies a feedwater control valve the function of which is to effect a modulation of the flow rate of the incoming feedwater. The steam drum itself is intended to function in the manner of a reservoir for the circulating water that through the operation of the circulating pump with which the subject waste heat boiler is also provided is made to flow to the steam generating bank. This circulating water upon being supplied to the steam generating bank is heated therein in known fashion to saturation temperature, whereupon steam is generated. From the steam generating bank, a water-steam mixture is returned to the steam drum and more particularly to the centrifugal water separator with which the steam drum is provided. In the centrifugal water separator the separation of the water-steam mixture is effected such that water flows to the lower portion of the steam drum while the steam passes to the upper portion of the steam drum. The feed mixing nozzle is suitably located in the line through which the water-steam mixture is returned from the steam generating bank to the steam drum. Further, the feed mixing nozzle is connected in fluid flow relation with the internal feed pipe through which the incoming feedwater is made to flow to the steam drum. As a consequence of the aforedescribed preheating of the incoming feedwater, wide changes in water temperature are avoided. Moreover, the effect of this is that the water level in the steam drum does not undergo extensive excursions. Namely, preheating of the feedwater that is being fed to the steam drum in the manner that has been described above is operative to accomplish an attenuation of the thermal shrink and swell that is known to occur within the steam drum of the waste heat boiler.

In accord with another aspect of the present invention a new and improved method is provided for accomplishing the production of low cost steam from heat that would otherwise be lost. The subject method encompasses the following. Feedwater is supplied to a steam drum at a controlled flow rate such as to maintain a desired water level within the steam drum. With the steam drum functioning as a reservoir water is circulated therefrom to a steam generating bank. The circulating water is then heated within the steam generating bank to saturation temperature whereupon steam is generated. A water-steam mixture is returned to the steam drum from the steam generating bank and more particularly to the centrifugal water separator located within the former. A separation of the water-steam mixture takes place within the centrifugal water separator such that the water flows to the lower portion of the steam drum while the steam passes to the upper portion of the steam drum. The feedwater which is supplied to the steam drum is preheated before it enters the steam drum by means of steam taken from the steam generating bank. This preheating of the feedwater is effective in preventing significant fluctuations, i.e., changes, from occuring in water temperature. Concomitantly, this preheating of the feedwater is operative for purposes of accomplishing an attenuation of the thermal shrink and swell which is known to occur in the steam drum of a waste heat boiler.

DESCRIPTION OF A PREFERRED EMBODIMENT

Figure 1:
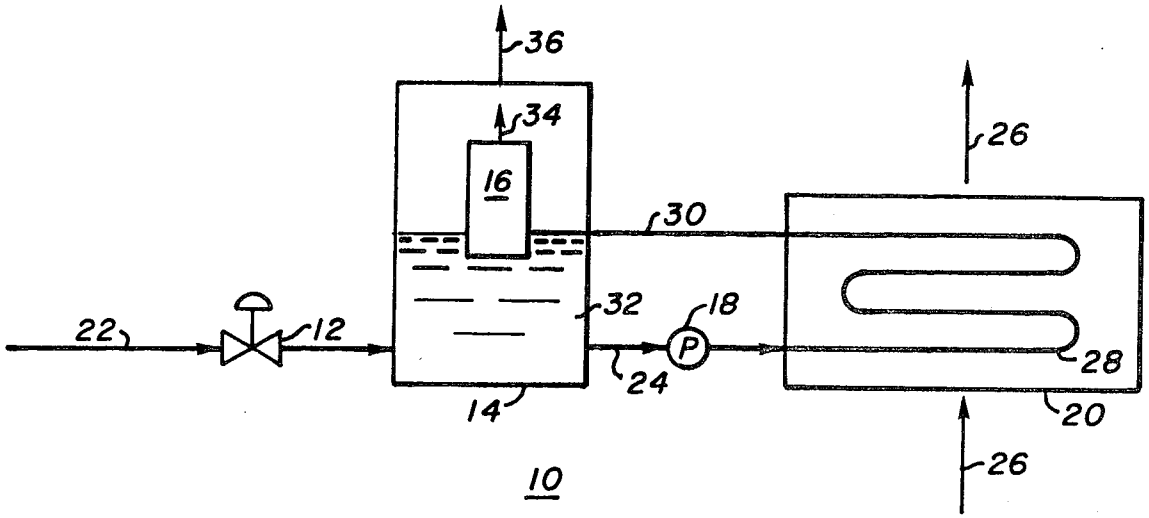
FIG. 1 is a schematic diagram of a waste heat boiler of conventional construction illustrating the flow path of the feedwater and circulating water therethrough.

Referring now to the drawing and more particularly to FIG. 1 thereof, the latter comprises a schematic diagram of a waste heat boiler, generally designated by reference numeral 10, that is of conventional construction. In accord with the illustration thereof in FIG. 1, the waste heat boiler 10 consists of the following components: a feedwater control valve 12, a steam drum 14, a centrifugal water separator 16, a circulating pump 18 and a steam generating bank 20.

With further reference to FIG. 1, incoming feedwater as schematically denoted therein by means of the line 22, is suitably supplied to the steam drum 14, where it enters the lower portion of the latter and mixes with the water that is already present in the steam drum 14. The flow rate of this incoming feedwater is modulated by means of the feedwater control valve 12. This is done in an effort to effect a modulation within steam drum 14 of the water level therewithin. That is, it is desired that the water level in the steam drum 14 be maintained at the desired water level; namely, that which has been established therefor by design considerations. The steam drum 14 in turn functions in the manner of a reservoir for the water that circulates to and fro between the steam drum 14 and the steam generating bank 20.

More specifically, circulating water leaves the steam drum 14, as schematically depicted in FIG. 1 by means of the line identified therein by the reference numeral 24 and is caused to flow to the steam generating bank 20. In accord with the illustration of FIG. 1, this circulation of water is accomplished by means of the circulating pump 18. However, if sufficient natural circulation can be obtained through the waste heat boiler 10, then the circulation pump 18 need not be employed. Namely, under such circumstances the circulating pump 18 could be omitted from the waste heat boiler 10. Upon being fed to the steam generating bank 20 under the influence of the circulating pump 18, the circulating water is heated therewithin to saturation temperature. The heat that is employed for this purpose commonly takes the form of waste gases that have been generated in any suitable fashion. The latter referenced waste gases are schematically depicted in FIG. 1 through the use of the lines that are denoted therein by means of the reference numeral 26. Continuing, as the circulating water flows through the tubes denoted by reference numeral 28 and is heated, steam is produced.

From the steam generating bank 20, a water-steam mixture is returned by means of the line shown schematically at 30 in FIG. 1 to the steam drum 14. More specifically, the water-steam mixture after exiting from the line 30 enters the centrifugal water separator 16 with which the steam drum 14 is suitably provided. The centrifugal water separator 16 in turn is operative to effect a separation from the water-steam mixture of the water which is returned to the lower portion of the steam drum 14 as depicted at 32 in FIG. 1, while the steam is supplied to the upper portion of the steam drum 14, as is shown in FIG. 1 by means of the line that is identified therein through the use of the reference numeral 34. Further, the steam then exits from the steam drum 14 in a suitable manner, the latter being schematically depicted in FIG. 1 by the line denoted therein by reference numeral 36.

Turning now to a description of the mode of operation of the waste heat boiler 10 of FIG. 1, under steady state operating conditions the tubes 28 of the steam generating bank 20 are divided into two different flow regions. To this end, the section of tubes 28 that receives the incoming circulating water that flows through line 24 under the influence of circulating pump 18 from the steam drum 14 to the steam generating bank 20 is filled with water at almost constant density. As such, the circulating water which flows through the initial section of tubes 28 of the steam generating bank 20 is heated to saturation temperature from an initially subcooled condition. The remaining section of tubes 28 of the steam generating bank 20 is filled with a constant temperature water-steam mixture of gradually decreasing density.

The temperature of the circulating water as it enters the tubes 28 of the steam generating bank 20 determines the relative amounts of water and steam which will be contained within the steam generating bank 20. A decrease in the temperature of the circulating water as it enters the steam generating bank 20 will cause a larger mass of water to be retained within the tubes 28 thereof. On the other hand, an increase in the temperature of the circulating water which is supplied to the steam generating bank 20 causes a smaller mass of water to be retained within the tubes 28 thereof. Accordingly, it should thus be noted that if circulating water is supplied at saturation temperature to the steam generating bank 20, there will exist therewithin no section of tubes 28 within which circulating water at subcooled temperatures is present. Consequently, boiling of the circulating water will take place within the initial section of tubes 28 of the steam generating bank 20, and the overall water-steam mixture which is contained within the steam generating bank 20 will represent the minimum mass of water that the steam generating bank 20 will contain under steady state flow conditions. The aforedescribed changes in temperature of the circulating water occasion a cyclic phenomenon in the stream drum 14 which is commonly referred to by those who are skilled in this art as thermal shrink and swell.

The phenomenon of cyclic thermal shrink and swell that takes place in the steam drum 14 of the waste heat boiler 10 is caused by the conflicting response of the steam drum 14 and the steam generating bank 20 to a change in the rate at which feedwater is supplied to the steam drum 14. More specifically, the following sequence produces this phenomenon of thermal shrink and swell. A decrease in the water level within the steam drum 14 causes the feedwater control valve 12 to open thereby in turn causing an increase in the rate of flow of feedwater to the steam drum 14. This increased flow of feedwater to the steam drum 14 causes a lowering of the temperature of the water that is present in the lower portion of the steam drum 14. The latter water which is now at a lower temperature is fed as circulating water through line 24 from the steam drum 14 to the steam generating bank 20. Because of its increased subcooling, the circulating water upon reaching the steam generating bank 20 causes, for the reasons set forth above, a larger volume, i.e., mass of water to be retained within the steam generating bank 20. Moreover, the circulating water is transferred from the steam drum 14 at a much higher rate of flow than the rate of flow at which the feedwater enters the steam drum 14. Therefore, the water level in the steam drum 14 falls. However, as the level of the water within the steam drum 14 falls, the feedwater control valve 12 causes additional feedwater to be admitted to the steam drum 14. Thus, a further subcooling of the water within the lower portion of the steam drum 14 takes place. Eventually, when temperature equilibrium has been established by the water that is contained in the lower portion of the steam drum 14, the water level within the steam drum 14 begins to rise. Concomitantly, with the increase in the water level within the steam drum 14, the flow of feedwater thereto under the control of the feedwater control valve 12 is reduced. This in turn causes an increase in the temperature of the water that reaches the stream generating bank 20 in the form of circulating water. Further, because of the increased temperature of the circulating water that is being supplied to the steam generating bank 20, the amount of water that is present in the steam generating bank 20 is reduced, as described previously hereinbefore, and the excess amount of water is returned to the steam drum 14 thereby causing a rapid increase in the water level therewithin.

Figure 2:
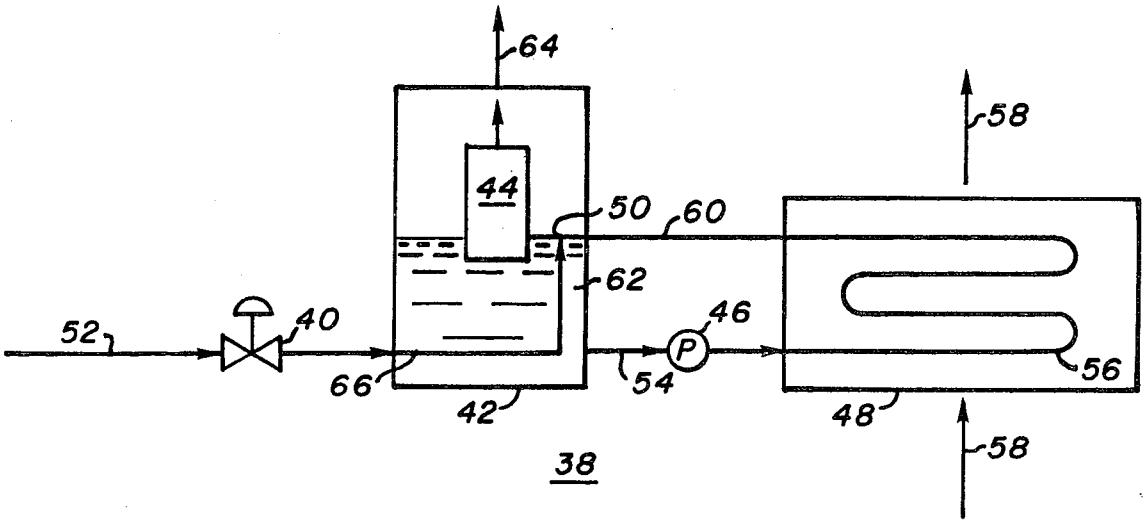
FIG. 2 is a schematic diagram of a waste heat boiler constructed in accordance with the present invention illustrating the flow path of the feedwater and circulating water therethrough.

Turning next to a consideration of FIG. 2 of the drawing, the latter comprises a schematic depiction of a waste heat boiler, generally designated therein by reference numeral 38, which is constructed in accordance with the present invention. The waste heat boiler 38 of FIG. 2 differs both in construction and in mode of operation from the waste heat boiler 10 of FIG. 1. More specifically, as set forth in the preceding description, the waste heat boiler 10 of FIG. 1 is disadvantageously characterized in that it suffers from the fact that wide excursions in the water level within the steam drum 14 can occur therewithin. Moreover, in at least a number of waste heat boiler applications the magnitude of these excursions can exceed the tolerances established by design considerations for acceptable fluctuations in the water level within the steam drum 14. The waste heat boiler 38 of FIG. 2, on the other hand, is not disadvantageously characterized in this respect. Namely, the waste heat boiler 38 does not suffer adversely from the phenomenon of cyclic thermal shrink and swell, which undesirably characterizes waste heat boilers constructed in the manner of and having the mode of operation of the waste heat boiler 10 of FIG. 1.

Continuing, a description will now be had of the nature of the construction of the waste heat boiler 38 of FIG. 2. To this end, the waste heat boiler 38 includes the following components suitably connected in operative relation one with another: a feedwater control valve 40, a steam drum 42, a centrifugal water separator 44, a circulating pump 46, a steam generating bank 48, and a mixing nozzle 50. More specifically, incoming feedwater is fed to the steam drum 42 through a line schematically depicted at 52 in FIG. 2. The rate of flow of the incoming feedwater is determined by means of the operation of the feedwater control valve 40. It is important to take note here of the fact that as will be described more fully hereinafter the incoming feedwater being supplied through the line 52 does not flow directly into the steam drum 42. Moreover, herein lies a very significant difference between the construction of the waste heat boiler 38 of FIG. 2 and the waste heat boiler 10 of FIG. 1. The significance of this difference will be pointed out more succinctly and more fully hereinafter.

Water from the steam drum 42 is transferred therefrom to the steam generating bank 48 through the line schematically depicted in FIG. 2 at 54. This water, commonly referred to as circulating water, is caused to flow to the steam generating bank 48 by virtue of the operation of the circulating pump 46. As in the case of the waste heat boiler 10 of FIG. 1, however, if sufficient natural circulation exists within the waste heat boiler 38 of FIG. 2, it may be possible to eliminate the circulating pump 46 as one of the operating components of the latter, i.e., of boiler 38. Flowing through the tubes 56 of the steam generating bank 48, the circulating water is suitably heated such that steam is produced therefrom. The heat required for this purpose is provided by hot gases that have been generated in any suitable fashion elsewhere, and to which the steam generating bank 48, as schematically depicted by the arrows 58 in FIG. 2, is subjected. A water-steam mixture in turn is made to return to the steam drum 42 from the steam generating bank 48. This is accomplished by means of the line shown at 60 in FIG. 1. More specifically, the water-steam mixture from the steam generating bank 48 is designed to flow to the centrifugal water separator 44 with which the steam drum 42 is suitably provided. Before reaching the centrifugal water separator 44, however, the water-steam mixture passes through a mixing nozzle, which is schematically denoted by the numeral 50 in FIG. 2. The reason for this will be discussed more fully subsequently. At this point it is deemed sufficient to merely make note of this fact.

Within the centrifugal water separator 44 a separation is had of the water-steam mixture that is received thereby. That is, the water from the water-stream mixture is in known fashion made to return to the lower portion, as shown at 62 in FIG. 2, of the steam drum 42. The steam from the water-steam mixture, on the other hand, in known fashion is made to pass into the upper portion of the steam drum 42, and exits from the latter in suitable fashion. The arrow identified by the reference numeral 64 in FIG. 2 is intended to schematically represent the steam that exits from the upper portion of the steam drum 42.

In accord with the present invention, it has been found that a significant factor in the elimination of the phenomenon of cyclic thermal shrink and swell in the steam drum in the waste heat boiler occasioned by changes in water temperature is the effectuation of a stabilization of the temperature of the water which is contained in the lower portion of the steam drum. To this end, with reference to the waste heat boiler 38 constructed as schematically depicted in FIG. 2, such stabilization of the temperature of the water within the lower portion of the steam drum 42 is accomplished by preheating the incoming feedwater which flows through the line 52 to the steam drum 42. Moreover, for this purpose steam from the steam generating bank 48 is employed. Thus, as best understood with reference to FIG. 2 of the drawing, this preheating of the incoming feedwater is effectuated by directing the incoming feedwater through an internal feed pipe, the latt?r being schematically depicted in FIG. 2 by the line that is identified therein by the reference numeral 66. The internal feed pipe 66 is operative to feed the incoming feedwater to the mixing nozzle 50 whereby the incoming feedwater is mixed with the water-steam mixture that flows through line 60 from the steam generating bank 48 to the centrifugal water separator 44.

Continuing, the flow of the incoming feedwater through the internal feed pipe 66 provides a small amount of convective cooling of the water that is located in surrounding relation thereto in the lower portion of the steam drum 42. Moreover, the effect thereof is to keep slightly subcooled the circulating water which is transferred from the steam drum 42 by the circulating pump 46 to the steam generating bank 48. This aids in preventing cavitation at the suction end of the circulating pump 46.

By being made to flow through the mixing nozzle 50 through which the water-steam mixture from the steam generating bank 48 is also made to pass, this insures that uniform heating of the feedwater takes place. Namely, a portion of the steam being returned to the steam drum 42 from the steam generating bank 48 is condensed. Further, the feedwater after being heated by virtue of being mixed with the water-stream mixture from the steam generating bank 48 is discharged along with the water from the water-stream mixture from the centrifugal water separator 44 into the lower portion of the steam drum 42. Most importantly, this water is discharged from the centrifugal water separator 44 at a constant temperature. Accordingly, the effect thereof is to obviate the occurrence of any significant changes in water temperature within the lower portion of the steam drum 42, and concomitantly eliminates the wide excursions in water level, i.e., cyclic thermal shrink and swell, which serves to plague the operation of waste heat boilers that embody the design of the waste heat boiler 10 of FIG. 1.

Thus, in accordance with the present invention there has been provided a new and improved form of waste heat boiler of the type that is operative to provide low cost steam from heat that would otherwise be lost. Moreover, the waste heat boiler of the present invention is particularly suited for use in marine applications. In addition, in accord with the present invention a waste heat boiler is provided which is effective in attenuating the thermal shrink and swell which takes place within the steam drum and which is occasioned by changes in water temperature. Further, the waste heat boiler of the present invention is effective in preventing excursions of more than ± two inches in the water level within the steam drum. Additionally, in accordance with the present invention a waste heat boiler is provided that is operative to provide a more efficient and effective mixing of the water within the steam drum. Also, the waste heat boiler of the present invention is equally applicable for use in new applications as well as retrofit applications. Furthermore, in accord with the present invention a waste heat boiler is provided that is relatively inexpensive to provide, yet is reliable in operation.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all the other modifications which fall within the true spirit and scope of my invention.

What is claimed is:

1. A device for attenuating cyclic thermal shrink and swell in the steam drum of a waste heat boiler embodying a steam drum, a steam generating bank and separating means all interconnected so as to collectively define a flow path through the waste heat boiler comprising a feed mixing nozzle including a first and a second inlet and an outlet, said first inlet being connected to the steam generating bank for receiving therefrom the output being discharged therefrom, said second inlet being connected in the path of flow of the input to the steam drum for receiving this input before the input is discharged into the steam drum, said feed mixing nozzle being operative to effect a combining therewithin of the input intended for the steam drum with the output discharged by the steam generating bank so as to effectuate a preheating of the input intended for the steam drum by the output from the steam generating bank, said outlet being connected to the separating means for discharging thereto the combined flow of the now preheated input intended for the steam drum and the output from the steam generating bank.

2. In a method for producing low cost steam from heat that would otherwise be lost comprising the steps of providing a supply of feedwater, feeding the feedwater to a steam drum, effecting the transfer of water from the steam drum to a steam generating bank, effecting the heating of the water within the steam generating bank to cause steam to be produced therefrom, returning a water-steam mixture from the steam generating bank to a separator, effecting the separation of the water and steam into separate entities from the water-steam mixture, the improvement consisting of effecting an attentuation of cyclic thermal shrink and swell in the steam drum by preheating the feedwater before the feedwater is received in the steam drum and is assimilated with the water already present in the steam drum comprising the steps of supplying the water-steam mixture being returned to the separator from the steam generating bank to a first inlet of a feed mixing nozzle, supplying the feedwater to a second inlet of the feed mixing nozzle prior to the feedwater being discharged into the steam drum, combining within the feed mixing nozzle the feedwater with the water-steam mixture so as to effectuate a preheating of the feedwater by the water-steam mixture, and discharging from the feed mixing nozzle to the separator the combined flow of the now preheated feedwater and the water-steam mixture.

3. In a method for producing low cost steam, the improvement consisting of effecting an attenuation of cyclic thermal shrink and swell in the steam drum as set forth in claim 2 further comprising the step of causing the feedwater to flow through the steam drum in fluid isolation to the contents of the steam drum before reaching the second inlet of the feed mixing nozzle.

4. In a waste heat boiler operative for purposes of producing low cost steam from heat that would otherwise be lost, the waste heat boiler including means for supplying incoming feedwater thereto, a steam drum for receiving the incoming feedwater, a feedwater control valve for regulating the rate of flow of the incoming feedwater to the steam drum, a steam generating bank for receiving circulating water from the steam drum and for heating the circulating water to produce steam therefrom, and separating means for receiving a water-steam mixture from the steam generating bank and for effecting a separation of the water and steam from the water-steam mixture into separate entities, the improvement comprising means for attenuating cyclic thermal shrink and swell in the steam drum by effecting a preheating of the incoming feedwater before the incoming feedwater is received within the steam drum and is assimilated with the water that is already present in the steam drum, said means having a first and a second inlet and an outlet, said first inlet being connected to the steam generating bank to receive therefrom the water-steam mixture being discharged therefrom, said second inlet being connected to the means for supplying incoming feedwater to the stream drum for receiving the incoming feedwater prior to the incoming feedwater being discharged into the steam drum, said means for attenuating cyclic thermal shrink and swell in the steam drum being operative to effect a combining therewithin of the incoming feedwater with the water-steam mixture so as to effectuate a preheating of the incoming feedwater by the water-steam mixture, said outlet being connected to the separating means for discharging thereto the combined flow of the now preheated incoming feedwater and the water-steam mixture.

5. In a waste heat boiler, the improvement of means for attenuating cyclic thermal shrink and swell as set forth in claim 4 wherein said means for attenuating cyclic thermal shrink and swell comprises a feed mixing nozzle located within the separating means.

6. In a waste heat boiler, the improvement of means for attenuating cyclic thermal shrink and swell as set forth in claim 5 wherein the incoming feedwater flows through the steam drum in fluid isolation to the contents of the steam drum before reaching said second inlet of said feed mixing nozzle.

* * * * *